US007702254B2

(12) United States Patent
Matsubara et al.

(10) Patent No.: US 7,702,254 B2
(45) Date of Patent: Apr. 20, 2010

(54) IMAGE FORMING APPARATUS HAVING MECHANISM FOR REDUCING PRESSING FORCE BETWEEN IMAGE BEARING MEMBER AND TRANSFERRING MEMBER

(75) Inventors: Hideyuki Matsubara, Mishima (JP); Kazunari Nishimoto, Numazu (JP)

(73) Assignee: Canon Kabushiki Kaisha, Tokyo (JP)

( * ) Notice: Subject to any disclaimer, the term of this patent is extended or adjusted under 35 U.S.C. 154(b) by 145 days.

(21) Appl. No.: 11/738,921

(22) Filed: Apr. 23, 2007

(65) Prior Publication Data

US 2007/0253730 A1 Nov. 1, 2007

(30) Foreign Application Priority Data

Apr. 27, 2006 (JP) ..... 2006-123941

(51) Int. Cl.
*G03G 15/08* (2006.01)
*G03G 15/00* (2006.01)

(52) U.S. Cl. ..... 399/121; 399/108

(58) Field of Classification Search ..... 399/121, 399/108

See application file for complete search history.

(56) References Cited

U.S. PATENT DOCUMENTS

| | | | | |
|---|---|---|---|---|
| 3,357,325 | A * | 12/1967 | Eichorn et al. | 399/121 |
| 6,665,507 | B1 * | 12/2003 | Hooper et al. | 399/110 |
| 7,198,155 | B2 | 4/2007 | Otsuka et al. | |
| 2003/0209464 | A1 | 11/2003 | Otsuka et al. | |
| 2004/0190958 | A1 * | 9/2004 | Matsumoto | 399/329 |
| 2005/0097950 | A1 * | 5/2005 | Singh et al. | 73/159 |
| 2005/0169664 | A1 * | 8/2005 | Arimitsu et al. | 399/111 |
| 2006/0280520 | A1 * | 12/2006 | Inada | 399/121 |

FOREIGN PATENT DOCUMENTS

| | | | |
|---|---|---|---|
| JP | 02-39169 | A | 2/1990 |
| JP | 07-15224 | A | 1/1995 |
| JP | 10-142969 | A | 5/1998 |
| JP | 11-015239 | A | 1/1999 |
| JP | 11-024452 | A | 1/1999 |
| JP | 2003-076117 | A | 3/2003 |
| JP | 2003-327293 | A | 11/2003 |
| JP | 2004-78212 | A | 3/2004 |
| JP | 2004-163708 | A | 6/2004 |
| JP | 2004-163709 | A | 6/2004 |
| JP | 2006-113283 | A | 4/2006 |

* cited by examiner

*Primary Examiner*—David M Gray
*Assistant Examiner*—Rodney Bonnette
(74) *Attorney, Agent, or Firm*—Canon U.S.A., Inc.; I.P. Division

(57) ABSTRACT

An image forming apparatus includes a photosensitive member and a transfer roller that are brought into pressure contact with each other by a force of a transfer spring to define a nip section therebetween. The transfer roller is movable between a first position at which the transfer roller is in pressure contact with the photosensitive member and a second position at which the pressure is eliminated or reduced. When the transfer roller is pushed to the second position, the transfer roller is latched at the second position and the apparatus can be carried in this state. When the apparatus is activated and the photosensitive member is driven, the transfer roller is unlatched and is returned to the first position by the force of the transfer spring, so that the nip section is formed again between the transfer roller and the image bearing member and an image forming process is enabled.

4 Claims, 14 Drawing Sheets

IMAGE FORMING APPARATUS HAVING MECHANISM FOR REDUCING PRESSING FORCE BETWEEN IMAGE BEARING MEMBER AND TRANSFERRING MEMBER

BACKGROUND OF THE INVENTION

1. Field of the Invention

The present invention relates to an image forming apparatus including a transferring member which forms a nip section together with an image bearing member and which transfers a toner image formed on the image bearing member onto a recording medium.

2. Description of the Related Art

In electrophotographic image forming apparatuses, a transfer roller is used to transfer a toner image formed on an image bearing member onto a recording medium while a recording medium passes through a nip section formed between the transfer roller and the image bearing member.

If such an image forming apparatus is transported while the photosensitive member and the transferring member are in pressure contact with each other, there are risks of permanent deformation of the transferring member, rubbing between the transferring member and the photosensitive member, and damage of the photosensitive member due to weakening material or bridging material applied to the transferring member, etc. In addition, when the image forming apparatus is transported, the apparatus is often placed in an environment like a ship's hold where the temperature and the like more greatly vary than in offices. This makes the above-described problems more serious. In order to solve these problems, techniques described below have been suggested.

For example, an image forming apparatus is known in which a photosensitive member and processing members related thereto are integrally formed as a cartridge that can be detachably attached to a main body of the apparatus. When this type of image forming apparatus is packed for transport, the cartridge is detached from the apparatus main body and is packed separately from the apparatus main body. In such a case, the above-described problems do not occur because the cartridge including the photosensitive member is packed separately from the apparatus main body. However, since the separately packed cartridge is stored in a single box together with the apparatus main body, a large box is necessary, which leads to an increase in transportation and shipping costs.

U.S. Patent Application Publication No. 2003/209464 (A1) discloses a packaging device for an image forming apparatus that accommodates a packed toner cartridge in a sheet storage space for storing sheets conveyed from an image forming unit. However, according to this publication, the sheet storage space in the image forming apparatus must be sufficiently large to receive the packed toner cartridge, and the size of the packaging device for packing such an image forming apparatus is increased accordingly. Thus, even when the toner cartridge is placed in the sheet storage space of the image forming apparatus, the separately packed toner cartridge is packed in a single packing device together with the apparatus main body. Therefore, the problems regarding the size of the packing box and the transportation and shipping costs cannot be solved.

SUMMARY OF THE INVENTION

The present invention is directed to an image forming apparatus that can solve the above-described problems, improve the workability in setting a main body of the apparatus, and ensure initialization of a transferring member.

The present invention provides an image forming apparatus including a supporting portion configured to support a cartridge, the cartridge being detachably attached to a main body of the image forming apparatus and including a rotatable image bearing member configured to bear a toner image; and a transferring member configured to transfer the toner image from the image bearing member, the transferring member being disposed in the main body and being moveable between a first position and a second position in the main body. The transferring member and the image bearing member define a nip section therebetween when the transferring member is at the first position. The second position is farther away from the image bearing member than the fist position. The main body is carried while the cartridge is attached to the main body, the transferring member is at the second position while the apparatus main body is being carried, and the transferring member is moved to the first position when the image bearing member is rotated after the main body is carried.

The present invention also provides an image forming apparatus including an image bearing member configured to bear a toner image; a transfer roller configured to transfer the toner image from the image bearing member, the transfer roller being movable between a first position and a second position, the transfer roller and the image bearing member defining a nip section therebetween when the transfer roller is at the first position, the second position being farther away from the image bearing member than the fist position; a pressing member configured to press the transfer roller in a direction from the second position to the first position; a holding member configured to hold the transfer roller at the second position; and a release member that moves when the transfer roller rotates. The holding member is moved in response to the movement of the release member, whereby the transfer roller is released from the holding member.

Further features of the present invention will become apparent from the following description of exemplary embodiments with reference to the attached drawings.

DESCRIPTION OF THE EMBODIMENTS

Embodiments of the present invention will be described in detail below with reference to the accompanying drawings. However, dimensions, materials, shapes, and relative positions of components described in the embodiments can be modified in accordance with the structure to which the present invention is applied and various conditions. Therefore, the present invention is not limited to the embodiments described below unless otherwise stated.

First Exemplary Embodiment

An image forming apparatus according to a first embodiment of the present invention will be described in detail below. In the first embodiment, a laser beam printer having a detachable process cartridge will be explained as an example of an image forming apparatus.

[Exemplary Structure of Electrophotographic Image Forming Apparatus]

Figure 1:
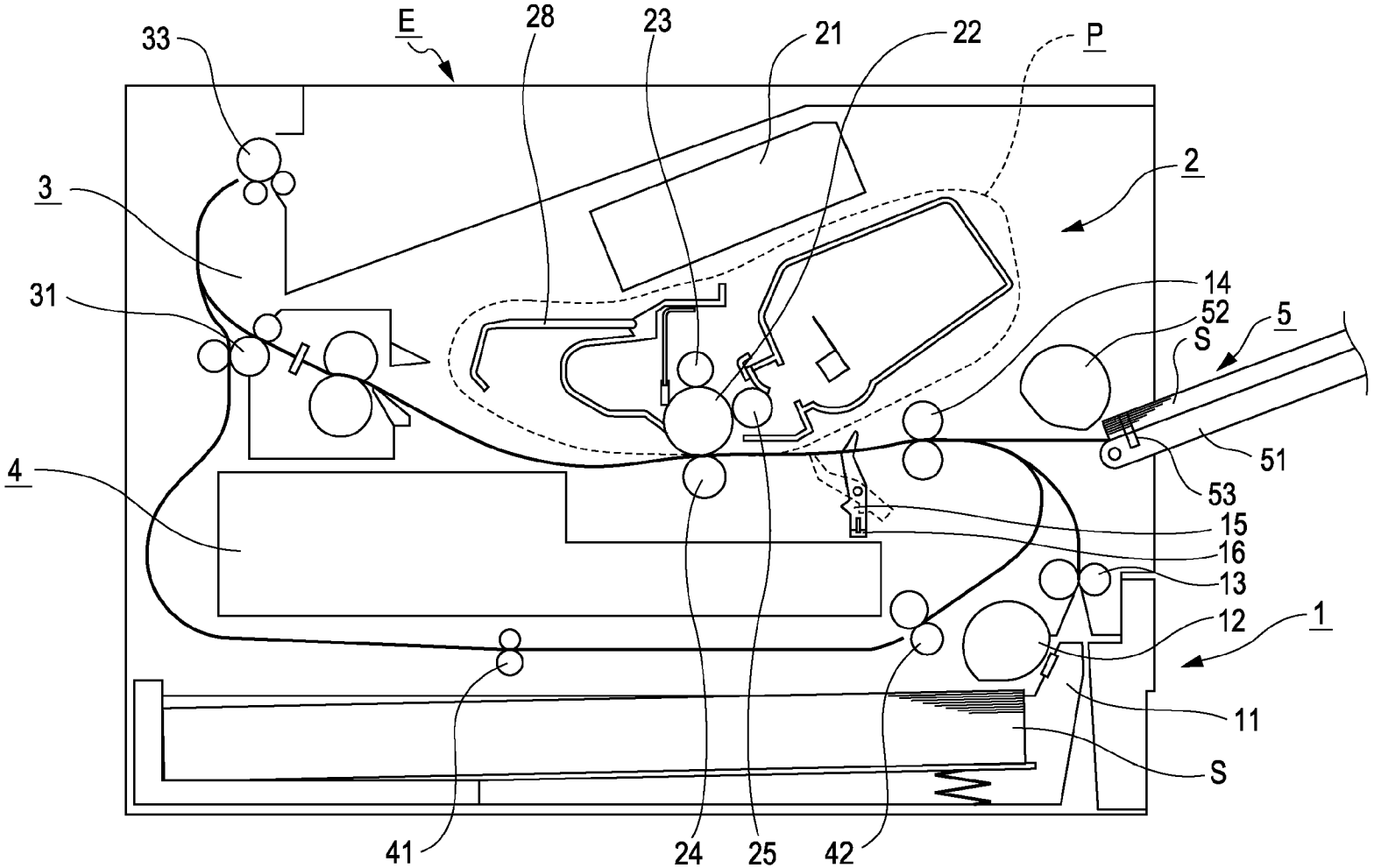
FIG. 1 is a schematic sectional view of an example image forming apparatus according to a first embodiment of the present invention.
Figure 2:
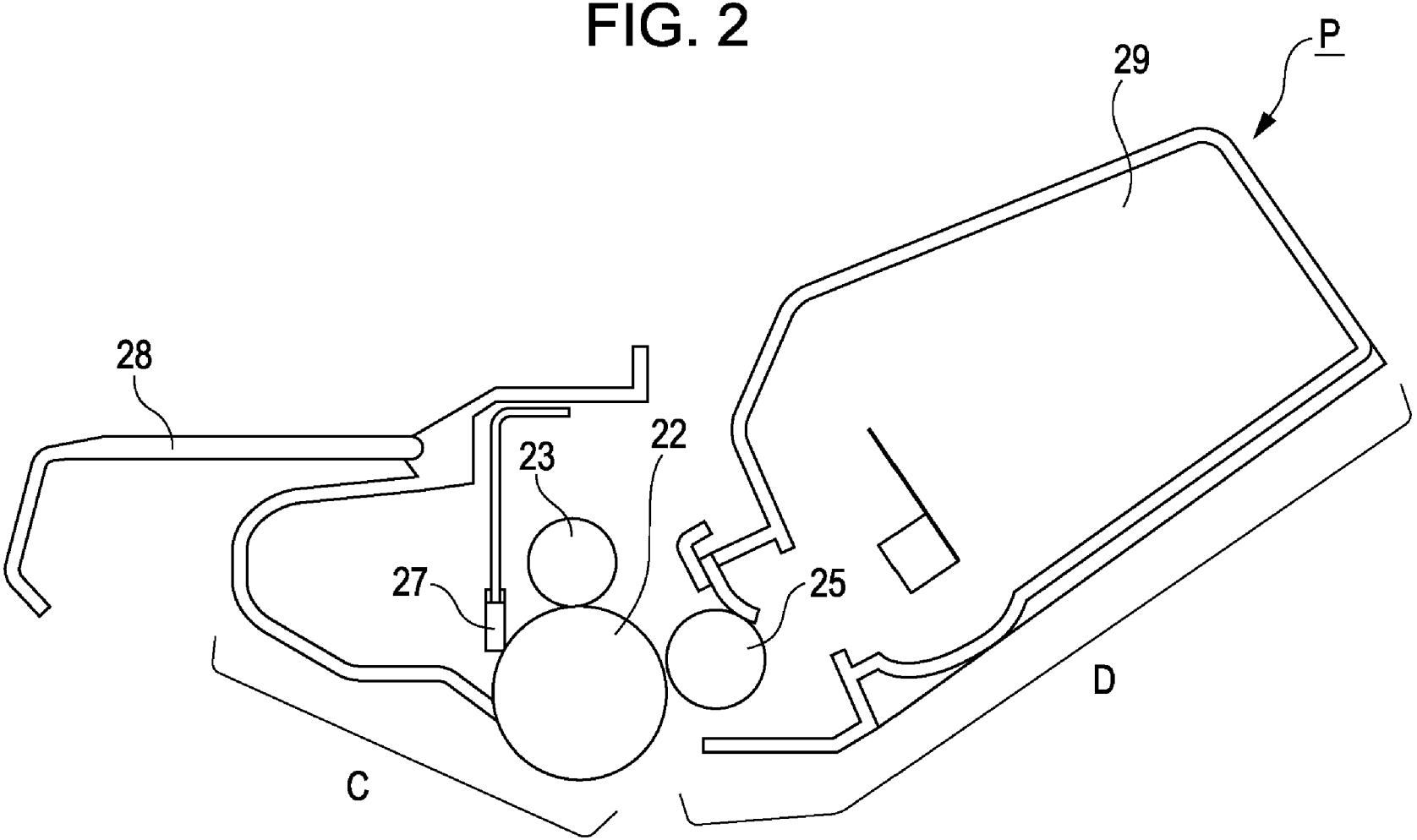
FIG. 2 is a schematic sectional view of an example process cartridge according to the first embodiment.

Referring to FIGS. 1 and 2, a schematic structure of the image forming apparatus will be described below in accordance with a movement of a recording medium S, such as a recording sheet. As shown in FIG. 1, an apparatus main body E forms an image on the recording medium S by an electrophotographic method. A sheet conveying unit 1 conveys the recording medium S to an image forming unit 2, where a toner image is transferred onto the recording medium S. Then, the recording medium S is conveyed to a fixing unit 3, where the toner image is fixed. Then, the recording medium S is conveyed to an eject unit. A cassette 11 that stores a stack of recording media S is placed in a lower section of the apparatus. In the sheet conveying unit 1, the recording media S in the cassette 11 are successively picked up from the top by a feed roller 12 that rotates counterclockwise, and are conveyed by pairs of conveying rollers 13 and 14 toward the image forming unit 2.

A sensor lever 15 and a photointerrupter 16 are provided near the image forming unit 2 for detecting the recording medium S when the recording medium S passes thereby. When a predetermined time elapses after the detection of the recording medium S, a laser scanner 21 emits a laser beam corresponding to image information toward a photosensitive member 22, which functions as an image bearing member and rotates clockwise. Accordingly, an electrostatic latent image is formed on the photosensitive member 22. The electrostatic latent image is developed by a developing unit included in a process cartridge P. The toner image formed on the photosensitive member 22 is transferred onto the recording medium S as an unfixed image by a transfer roller 24, which functions as a transferring member, in a transferring unit. The recording medium S on which the unfixed image is formed is conveyed to the fixing unit 3, which carries out a fixing process. After the fixing process, the recording medium S leaves the fixing unit 3 and is conveyed by pair of ejecting/conveying rollers 33 to the eject unit disposed in an upper section of the apparatus.

In FIG. 1, an electric unit 4 includes a power supply unit of the apparatus and a control board for controlling the apparatus.

A duplex recording operation for recording on both sides of the recording medium S will be described below. In the duplex recording operation, after the recording medium S having an image recorded on a front side thereof leaves the fixing unit 3, a switch-back process is performed to return the recording medium S by driving conveying rollers 31 and rotating the ejecting/conveying rollers 33 in a reverse direction. Then, the recording medium S is conveyed to the image forming unit 2 again by pairs of conveying rollers 41 and 42, and an image is recorded on a back side of the recording medium S in the above-described manner. Then, the recording medium S is ejected.

When the recording media S are to be fed from a manual paper feed unit 5, first, a manual paper feed tray 51 is opened and the recording media S are placed thereon. The recording media S placed on the manual paper feed tray 51 are successively fed from the top by a feed roller 52 that rotates clockwise, and are conveyed by the pair of conveying rollers 14 to the image forming unit 2. A recording medium detection sensor 53 detects the presence or absence of the recording medium S on the tray 51. Processes performed after the recording medium S reaches the image forming unit 2 are similar to those described above, and detailed explanations thereof are thus omitted.

In the process cartridge P, the photosensitive member 22 is rotated and is uniformly charged when a voltage is applied to a charging roller 23, which functions as a charging unit. The voltage is supplied from an electrification contact (not shown) in the electric unit 4 of the apparatus main body E to an electrification contact (not shown) in the process cartridge P, and then to the charging roller 23. Next, the laser scanner 21 emits a laser beam corresponding to image information toward the photosensitive member 22 and thereby forms a latent image on the photosensitive member 22. Then, the latent image is developed with toner in the developing unit.

The charging roller 23 is arranged to be in contact with the photosensitive member 22 to charge the photosensitive member 22. The charging roller 23 is rotated by the rotation of the photosensitive member 22. The developing unit develops the latent image formed on the photosensitive member 22 by supplying toner to a development region of the photosensitive member 22 using a development roller 25. After the toner image is transferred onto the recording medium S by the transfer roller 24, toner remaining on the photosensitive member 22 is removed by a cleaning blade 27, which functions as a cleaning unit. Thus, the photosensitive member 22 prepares for the next image forming process.

A drum shutter 28 is closed to protect the photosensitive member 22 when the process cartridge P is detached from the apparatus main body E, and is opened when the process cartridge P is attached to the apparatus main body E, as shown in FIG. 1. The process cartridge P is attached to the apparatus main body E at a position where the image forming operation can be performed.

As shown in FIG. 2, the process cartridge P includes a photosensitive member unit C and a developing unit D that are integrated with each other. The photosensitive member unit C includes the photosensitive member 22, the charging roller 23, the cleaning blade 27, etc. The developing unit D includes the development roller 25, a toner container 29, etc.

The process cartridge P can be detachably attached to the apparatus main body E by a user. The image forming apparatus according to the first embodiment is packed and transported to the user while the process cartridge P is attached to the apparatus main body E, as described in detail below.

[Exemplary Structure and Basic Operation of Transferring Unit]

An exemplary structure and operation of the transferring unit included in the above-described image forming apparatus will be described below.

Figure 3B:
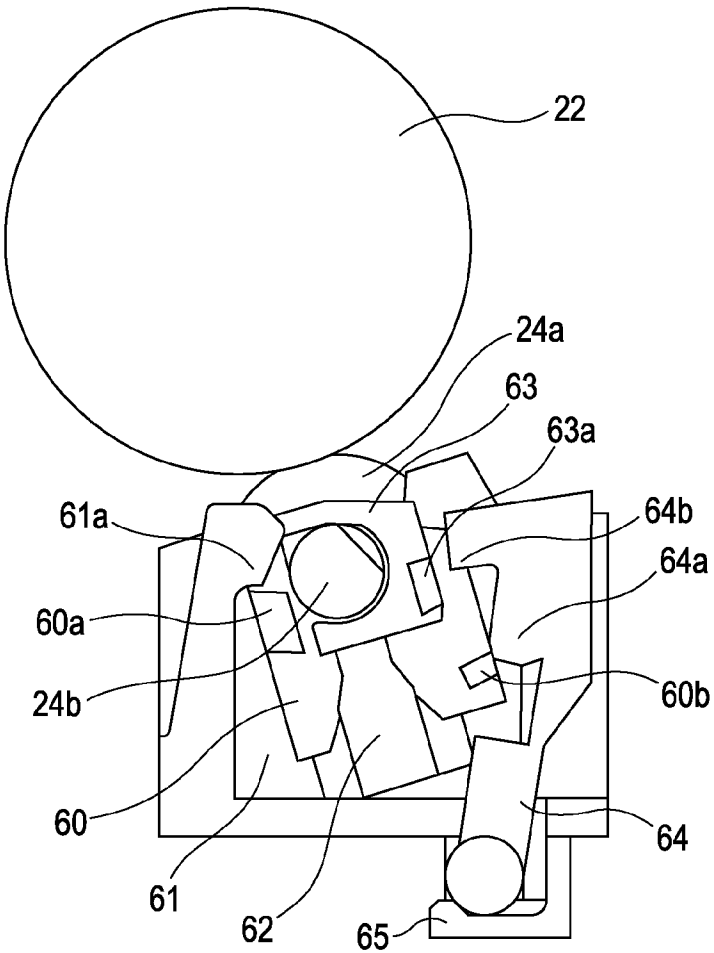
FIG. 3B is a schematic sectional view of the transferring unit according to the first embodiment in the state in which the nip section is formed by the image bearing member and the transfer roller.
Figure 3A:
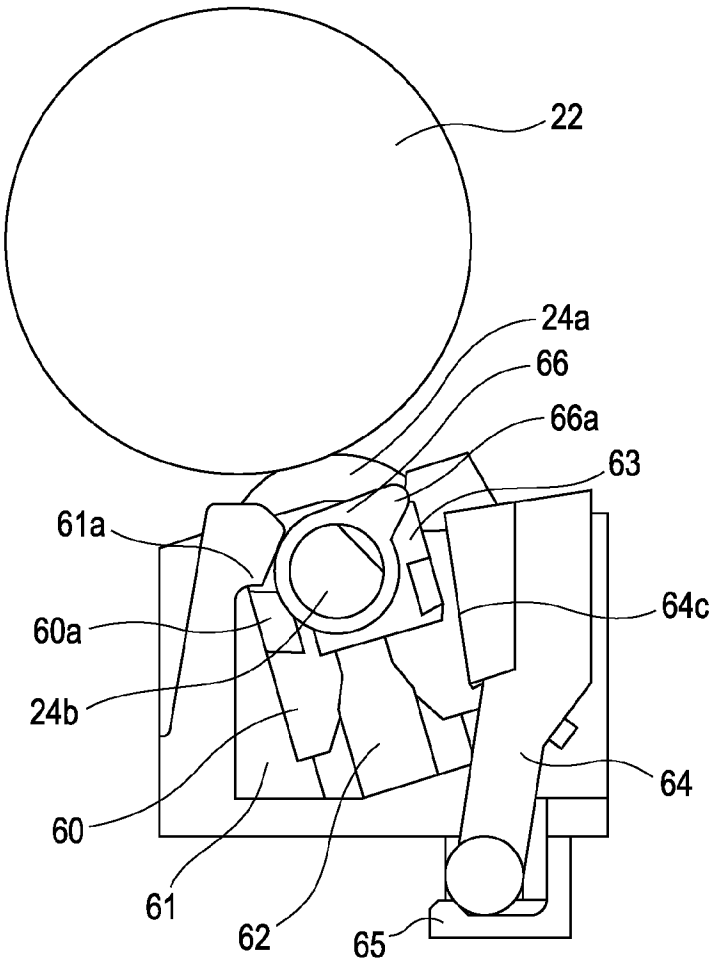
FIG. 3A is a schematic sectional view of an example transferring unit according to the first embodiment in the state in which a nip section is formed by an image bearing member and a transfer roller.
Figure 4B:
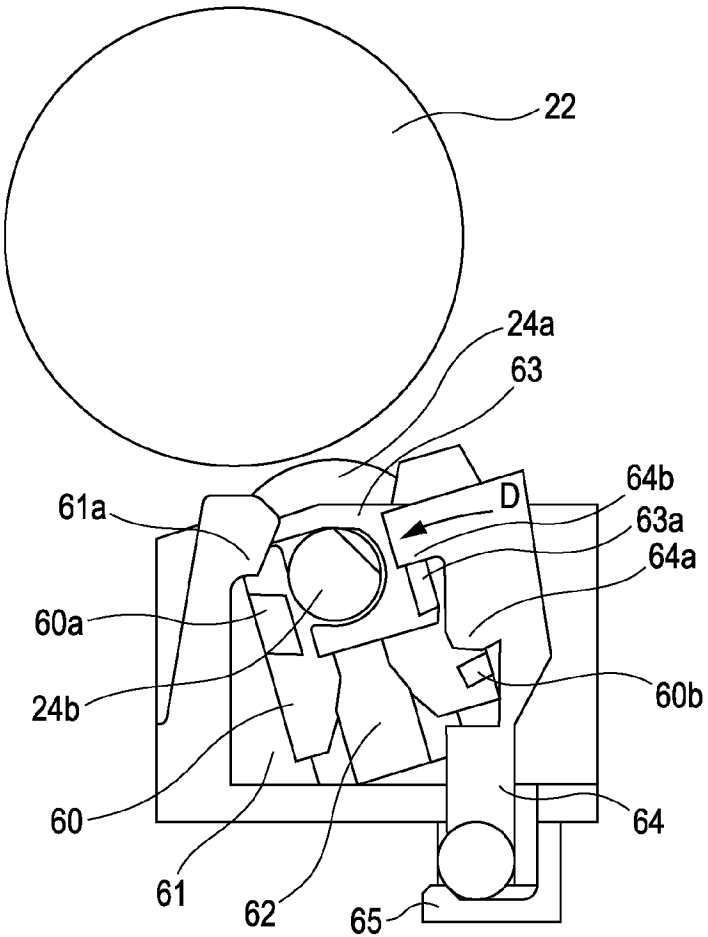
FIG. 4B is a schematic sectional view of the transferring unit according to the first embodiment in the state in which the image bearing member and the transfer roller are separated from each other.
Figure 4A:
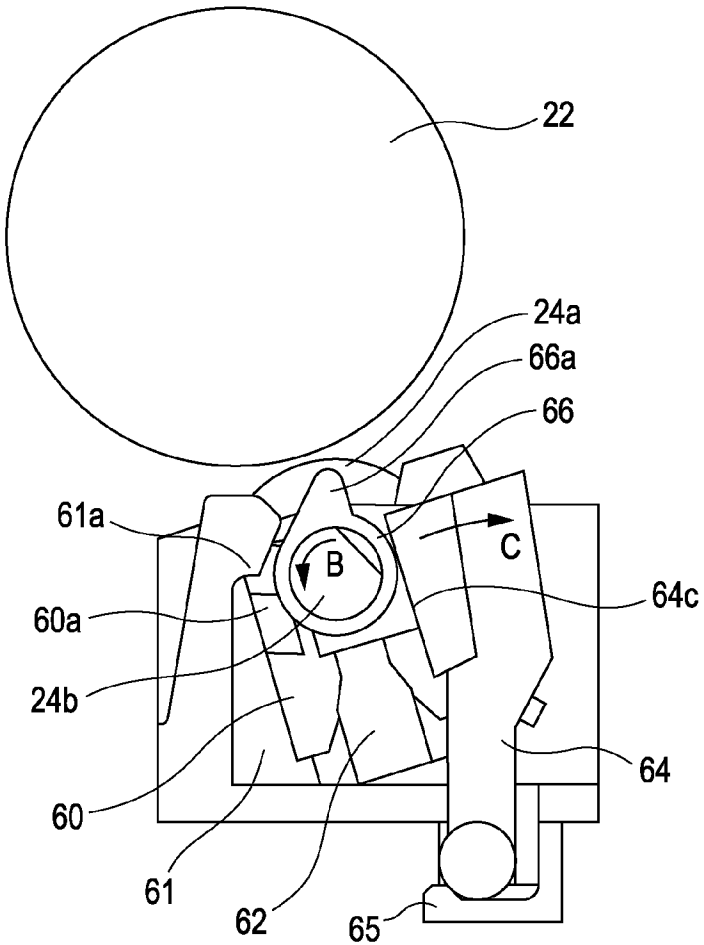
FIG. 4A is a schematic sectional view of the transferring unit according to the first embodiment in the state in which the image bearing member and the transfer roller are separated from each other.
Figure 5B:
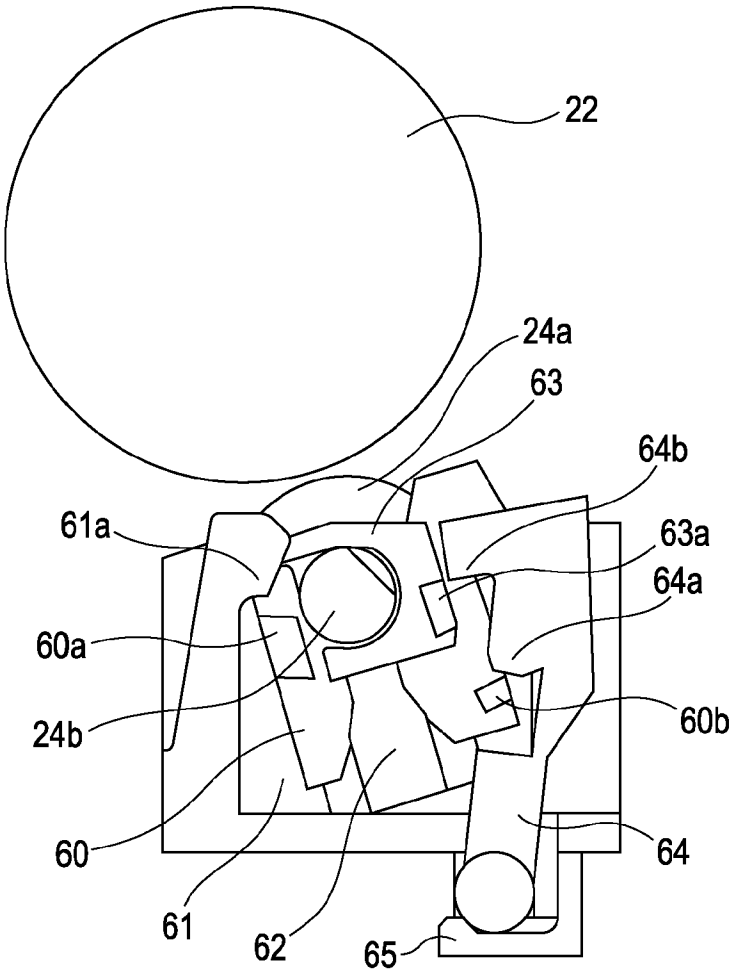
FIG. 5B is a schematic sectional view of the transferring unit according to the first embodiment illustrating the manner in which the releasing operation is performed.
Figure 5A:
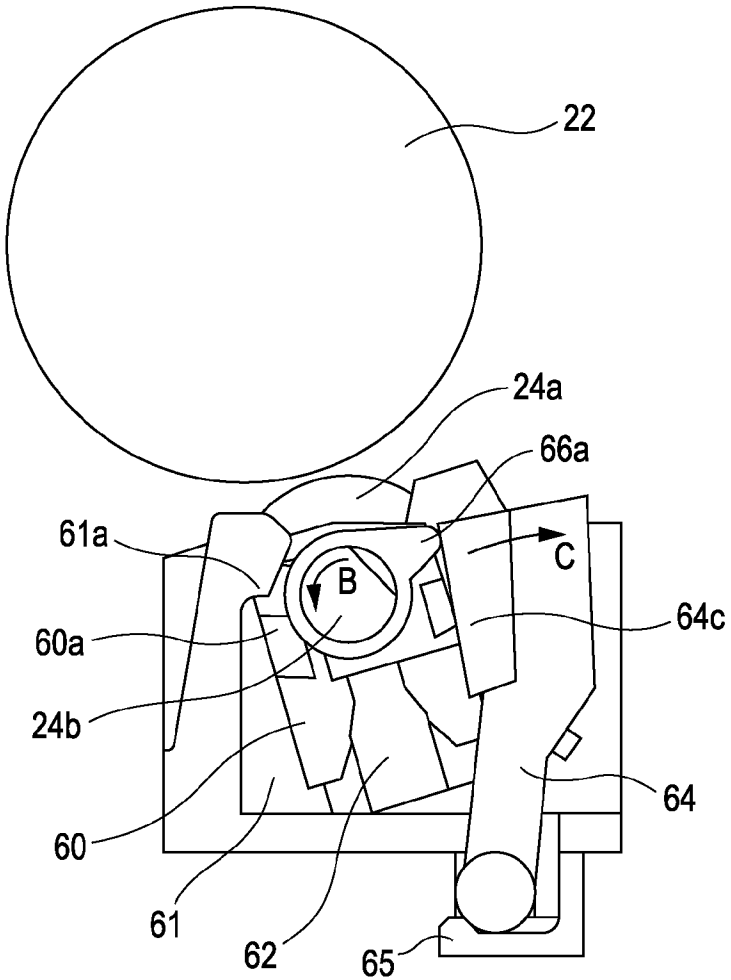
FIG. 5A is a schematic sectional view of the transferring unit according to the first embodiment illustrating the manner in which a releasing operation is performed.
Figure 6:
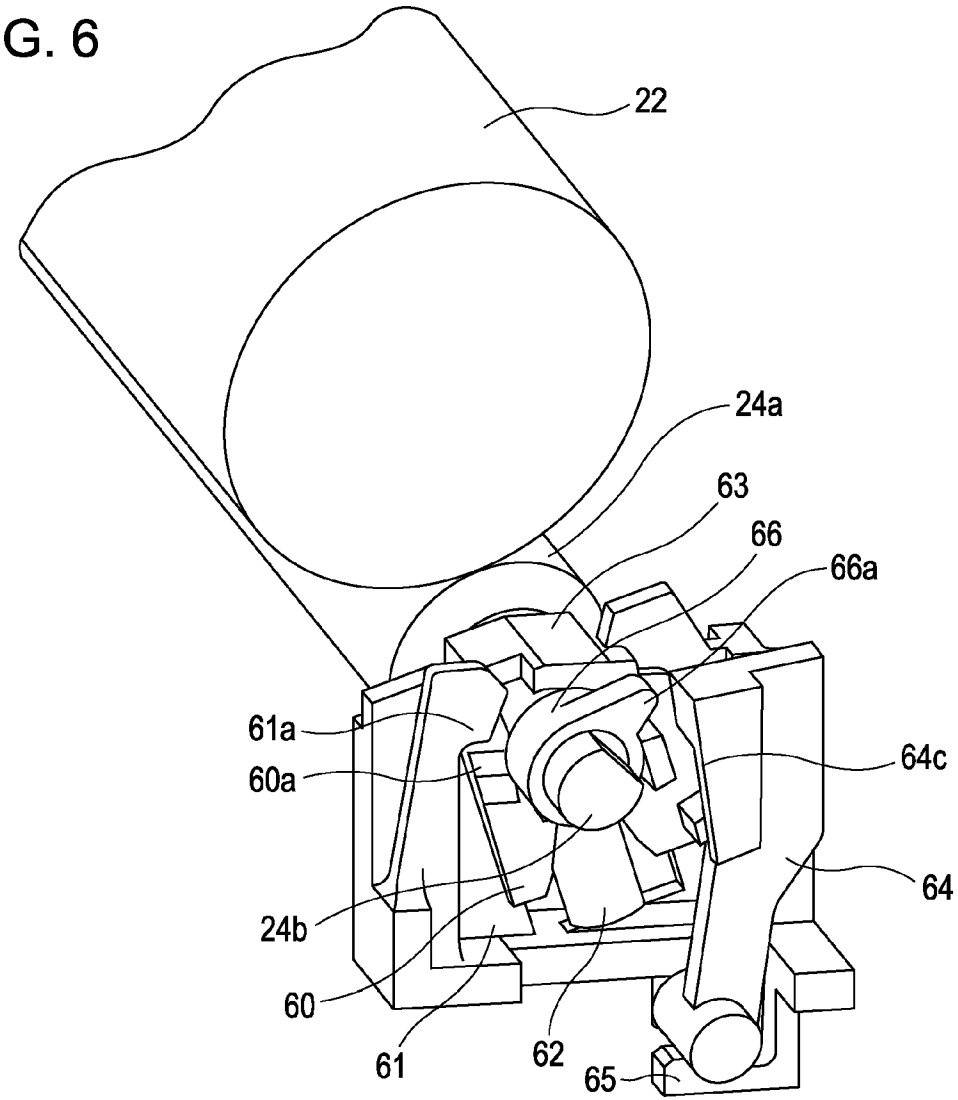
FIG. 6 is a schematic perspective view of a section around the transfer roller according to the first embodiment.
Figure 7:
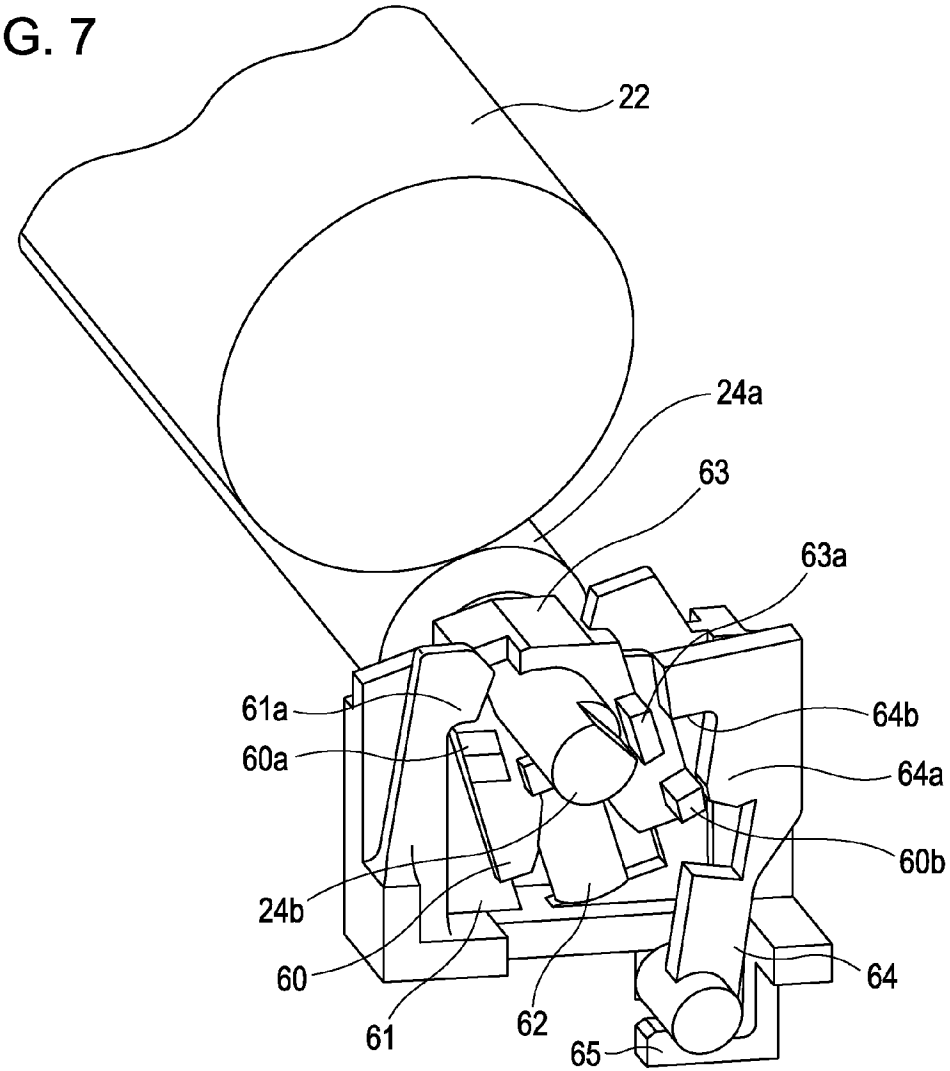
FIG. 7 is a schematic perspective view of a section around the transfer roller according to the first embodiment.
Figure 8B:
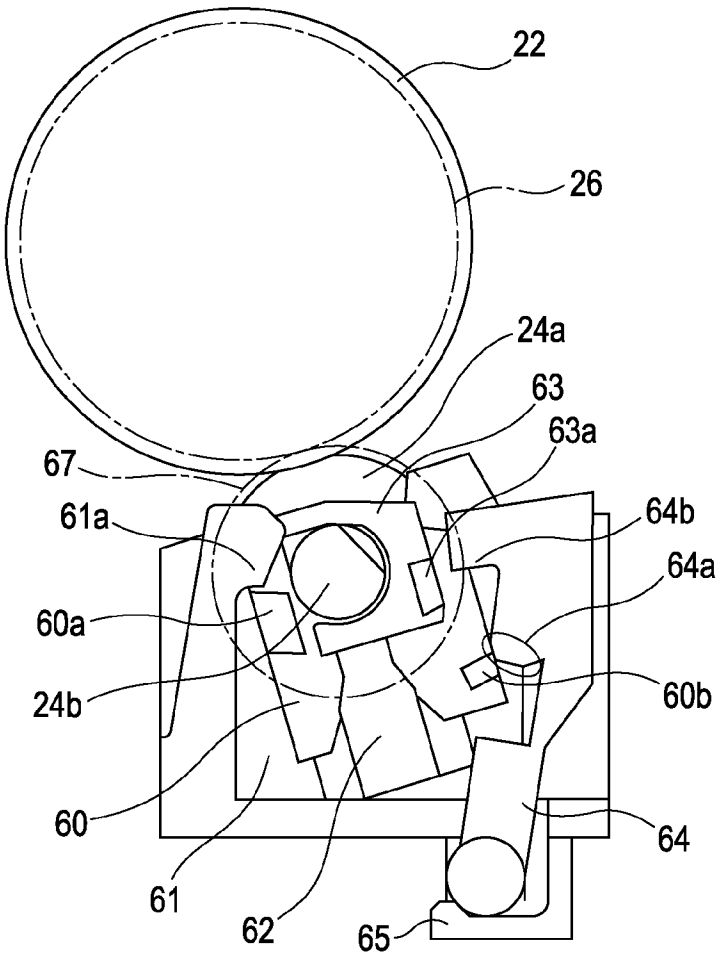
FIG. 8B is a schematic sectional view of the transferring unit according to the first embodiment in the state in which the nip section is formed by the image bearing member and the transfer roller.
Figure 8A:
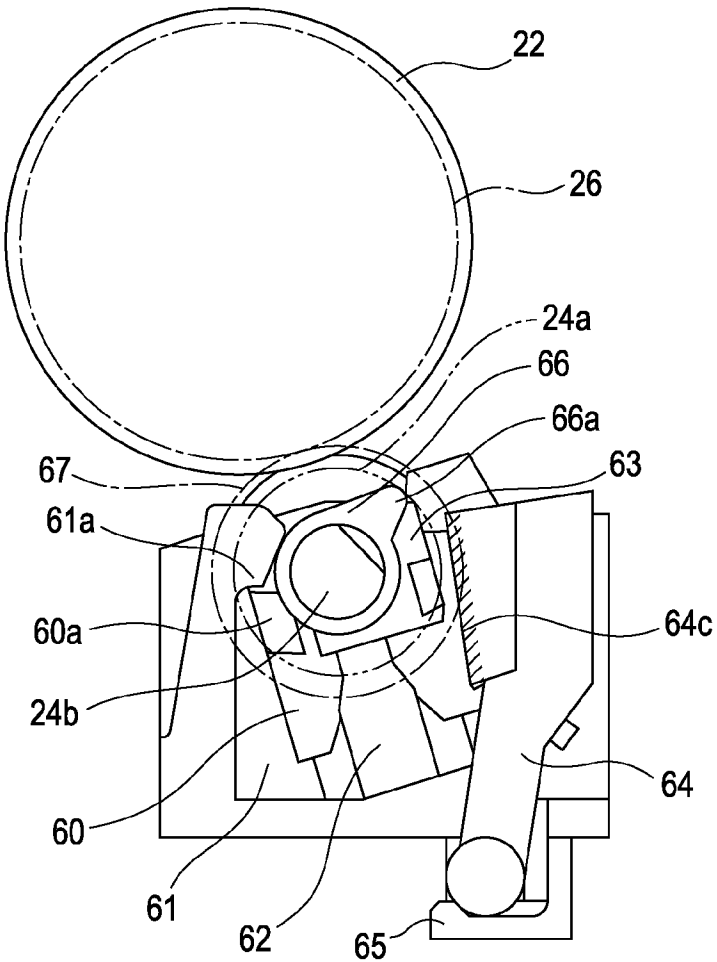
FIG. 8A is a schematic sectional view of the transferring unit according to the first embodiment in the state in which the nip section is formed by the image bearing member and the transfer roller.

FIGS. 3A and 3B are schematic sectional views of the transferring unit in the state in which the transferring member is in pressure contact with the photosensitive member (the state in which the image bearing member and the transferring member are forming a nip section). FIGS. 4A and 4B are schematic sectional views of the transferring unit in the state in which the photosensitive member and the transferring member are separated from each other. FIGS. 5A and 5B are schematic sectional views of the transferring unit, illustrating a releasing operation. FIGS. 3B, 4B, and 5B show the states in which a release surface 64*c* of a separation hook 64 and a release member 66 are removed from the structures shown in FIGS. 3A, 4A, and 5A, respectively. FIG. 6 is a perspective view of the transferring unit in the state shown in FIG. 3A, and FIG. 7 is a perspective view of the transferring unit in the state shown in FIG. 3B.

As shown in FIGS. 3A and 3B, the transfer roller 24 includes a roller member 24*a* and a shaft portion 24*b* at each end of the roller member 24*a*. The shaft portions 24*b* are rotatably supported by respective bearings 60. Each bearing 60 is supported by a bearing support portion 61 disposed in the apparatus main body E, and is urged toward the photosensitive member 22 by a transfer spring 62 which functions as a pressing member. In the state in which the process cartridge P is not attached (that is, in the state in which the photosensitive member 22 is detached from the apparatus main body E), a projecting portion 60*a* provided on the bearing 60 prevents the bearing 60 from being released by coming into contact with a stopper portion 61*a* provided on the bearing support portion 61. The bearing 60 is U-shaped and the transfer roller 24 is readily interchangeable while the process cartridge P is not attached. In addition, as shown in FIG. 6, a shaft cover 63 is attached to the shaft portion 24*b* at each end of the transfer roller 24 so as to prevent paper dust or the like from entering a space between the shaft portion 24*b* and the bearing 60.

The transfer roller 24 is movable between a first position (position shown in FIGS. 3A and 3B) at which the transfer roller 24 is in pressure contact with the photosensitive member 22 and a second position (position shown in FIGS. 4A and 4B) at which the transfer roller 24 is separated from the photosensitive member 22. Although the position at which the transfer roller 24 is separated from the photosensitive member 22 is described as an example of the second position in the first embodiment, the present invention is not limited to this. For example, the second position of the transfer roller 24 can also be a position where the pressure applied to the photosensitive member 22 is eliminated or reduced.

When the transfer roller 24 is moved from the first position to the second position, the transfer roller 24 is latched at the second position. Then, when the transfer roller 24 receives a rotational driving force, the transfer roller 24 is released from the latched state and moves (returns) to the first position from the second position due to the force of the transfer spring 62. This will be described in more detail below.

A separation hook 64 for latching the bearing 60 and the shaft cover 63 is pivotally supported by a separation hook support 65 disposed in the apparatus main body E. The separation hook 64 is urged by an elastic member (not shown) toward the transfer roller 24, that is, in the direction shown by the arrow D in FIG. 4B. The separation hook 64 functions as a latch member for latching the transfer roller 24 at the second position. When the transfer roller 24 is at the first position, a stopper portion 64*a* of the separation hook 64 come into contact with the projecting portion 60*b* of the bearing 60 at an end thereof, as shown in FIG. 3B.

FIGS. 8A, 8B, 9A, and 9B are diagrams obtained by additionally drawing gears for transmitting the rotational force to the transfer roller 24 by dashed lines in FIGS. 3A, 3B, 4A, and 4B, respectively. A photosensitive-member gear (image-bearing-member gear) 26 and a transfer gear 67 are fixed to the photosensitive member 22 and the transfer roller 24, respectively, such that a driving force can be transmitted. In FIGS. 8A, 8B, 9A, and 9B, the gears 26 and 67 are shown by pitch circles. When the process cartridge P is attached to the apparatus main body E, the photosensitive-member gear 26 and the transfer gear 67 mesh with each other, so that the power from the apparatus main body E can be transmitted from the photosensitive member 22 to the transfer roller 24. In this state, the photosensitive member 22 rotates and the transfer roller 24 is rotated by the rotation of the photosensitive member 22. Thus, the process of transferring the toner image formed on the photosensitive member 22 onto the recording medium S while conveying the recording medium S is performed. Tooth heights of the photosensitive-member gear 26 and the transfer gear 67 are set such that gears 26 and 67 can maintain the meshed state even when the transfer roller 24 is separated from the photosensitive member 22 and an interval between the pitch circles of the gears 26 and 67 is increased.

Accordingly, the driving force can be transmitted to the transfer roller 24 and the transfer roller 24 can be rotated irrespective of whether the transfer roller 24 is at the first position or the second position. When the transfer roller 24 is rotated, the release member 66 fixed on the shaft portion 24*b* of the transfer roller 24 is also rotated.

Referring to FIGS. 4A, 4B, 5A, and 5B, the release member 66 provided on the transfer roller 24 serves to cancel the state in which the transfer roller 24 is latch at the second position. When the transfer roller 24 rotates, the release member 66 pushes the separation hook 64 in a direction opposite to the direction shown by the arrow D, thereby cancelling the latched state of the separation hook 64. Accordingly, when the transfer roller 24 rotates, the transfer roller 24 comes into contact with the photosensitive member 22.

If the transfer roller 24 is moved to the first position while the process cartridge P is attached to the apparatus main body E, the roller member 24*a* of the transfer roller 24 comes into contact with the photosensitive member 22. Therefore, as shown in FIGS. 3A and 3B, the roller member 24*a* of the transfer roller 24 is deformed inward along the periphery of the photosensitive member 22, and thereby forms a nip section.

According to the first embodiment, a separating operation for the transfer roller 24 can be easily performed before attaching the process cartridge P to the apparatus main body E. The separating operation for the transfer roller 24 will be described below. After the separating operation for the transfer roller 24, the process cartridge P is attached to the apparatus main body E. At this time, the photosensitive member 22 and the transfer roller 24 are separated from each other in a stable state due to the above-mentioned separating operation. In this state, the image forming apparatus is packed and transported through various routes. Since the image forming apparatus is packed in a state in which the process cartridge P is attached to the apparatus main body E, the package box is small and the transportation efficiency is increased. After the user opens the package and installs the apparatus, the separated state of the transfer roller 24 is canceled simply by activating the apparatus main body. Thus, the transfer roller 24 can be set to a state in which the image-forming process can be performed without causing the user to perform a complex task. The separating operation for the transfer roller 24 and a releasing operation for cancelling the separated state will be described in more detail below.

[Exemplary Separating Operation]

The separating operation for the transfer roller 24 performed to prevent the photosensitive member 22 in the process cartridge P from coming into contact with the transfer roller 24 when the process cartridge P is attached to the apparatus main body E will be described below.

Figure 9B:
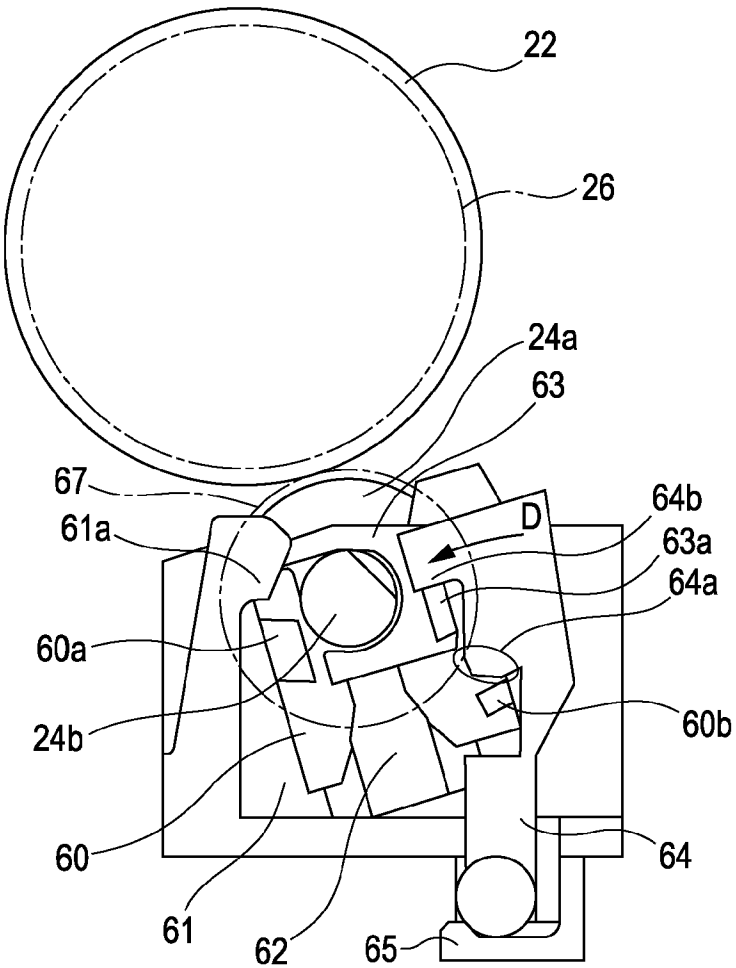
FIG. 9B is a schematic sectional view of the transferring unit according to the first embodiment in the state in which the image bearing member and the transfer roller are separated from each other.
Figure 9A:
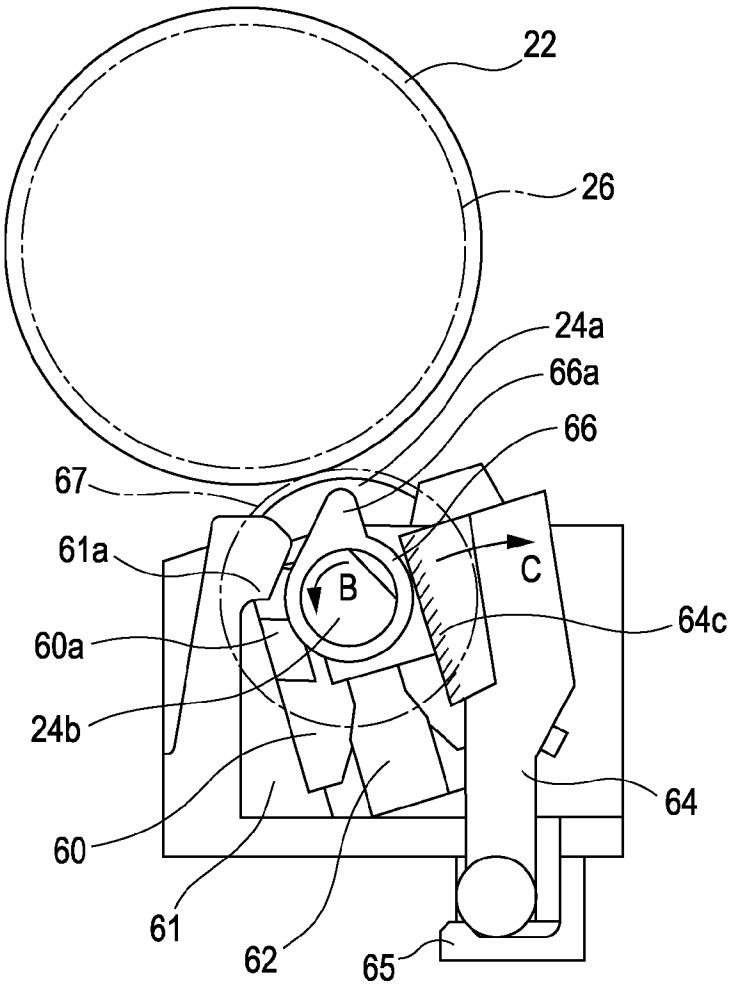
FIG. 9A is a schematic sectional view of the transferring unit according to the first embodiment in the state in which the image bearing member and the transfer roller are separated from each other.
Figure 10B:
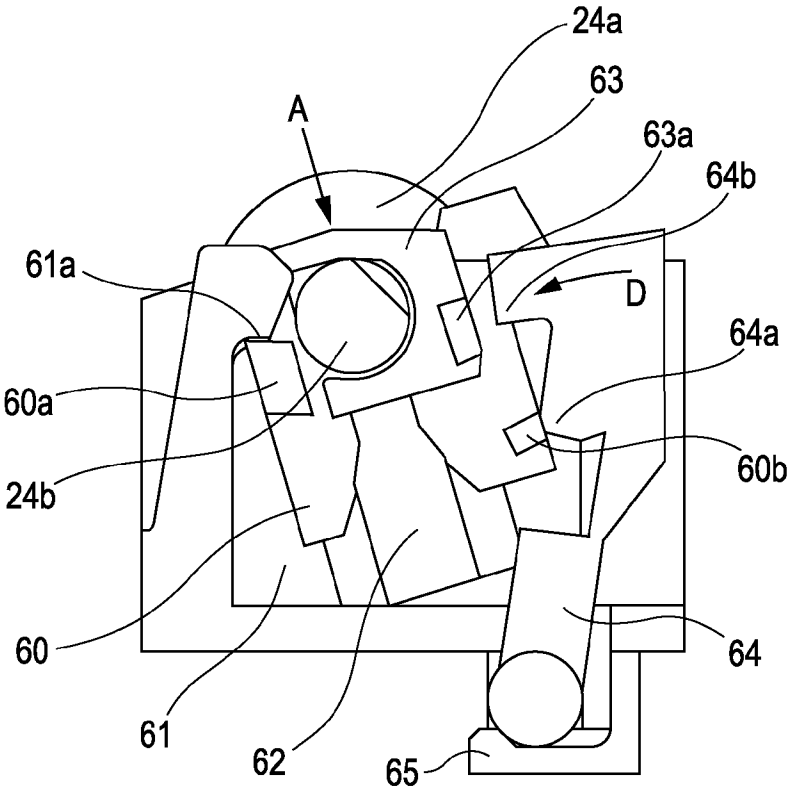
FIG. 10B is a schematic sectional view of the transferring unit according to the first embodiment in the state in which an image bearing member is detached from the apparatus main body.
Figure 10A:
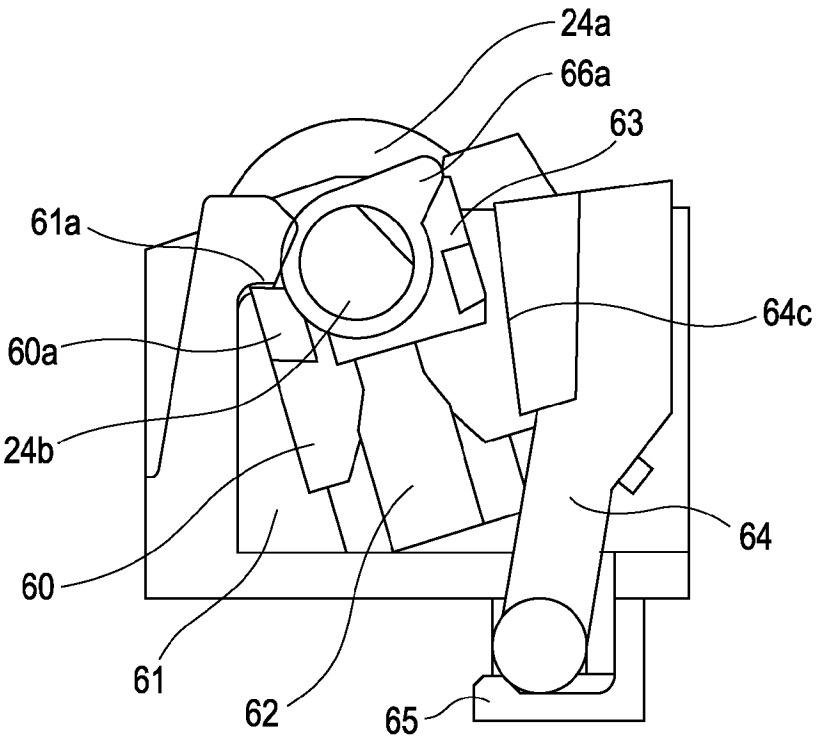
FIG. 10A is a schematic sectional view of the transferring unit according to the first embodiment in the state in which an image bearing member is detached from the apparatus main body.

An operator performs the separating operation for the transfer roller 24 before attaching the process cartridge P to the apparatus main body E. More specifically, the operator presses an upper portion of the shaft cover 63 downward in the direction shown by the arrow A in FIG. 10B against the pressing force of the transfer spring 62. Accordingly, the transfer roller 24, the bearing 60, the shaft cover 63, the release member 66, and the transfer gear 65 are moved away from the position where the photosensitive member 22 is to be placed. At this time, as shown in FIG. 10B, the stopper portion 64*a* of the separation hook 64 is separated from the edge of the projecting portion 60*b* of the bearing 60 and the separation hook 64 is moved in the direction shown by the arrow D in FIG. 10B due to the urging force of an elastic member (not shown). Accordingly, a latch portion 64*b* of the separation hook 64 retains a projecting portion 63*a* of the shaft cover 63 against the urging force of the transfer spring 62, thereby maintaining the separated state of the transfer roller 24. Thus, when the transfer roller 24 is moved to the second position where the transfer roller 24 is separated from the position where the photosensitive member 22 is to be placed, the separation hook 64 is moved to a latch position (position shown in FIGS. 9A and 9B) so as to latch the transfer roller 24 at the second position.

The stopper portion 64*a* of the separation hook 64 latches the bearing 60 while a small clearance is provided between the stopper portion 64*a* and the projecting portion 60*b*. Therefore, even when the shaft cover 63 is bent by the urging force of the transfer spring 62, the separated state of the transfer roller 24 can be maintained by latching the bearing 60 with the separation hook 64.

In the separating operation, if a release portion 66*a* of the release member 66 is at a position where the release portion 66*a* comes into contact with a receiving surface 64*c* of the separation hook 64, the receiving surface 64*c* pushes the release portion 66*a* and thereby rotates the transfer roller 24. Accordingly, the transfer roller 24 can be reliably set to the separated state. More specifically, the release member 66 having the release portion 66*a*, which acts on the separation hook 64 so as to move the separation hook 64 to a latch-releasing position, rotates together with the transfer roller 24. Therefore, the release portion 66*a* does not obstruct the movement of the transfer roller 24 from the first position to the second position.

As described above, the state in which the photosensitive member 22 and the transfer roller 24 are separated from each other can be established by an extremely simple process, and the separated state can be stably maintained while the apparatus is being transported or shipped. As a result, the problems of permanent deformation of the transfer roller 24, rubbing between the transfer roller 24 and the photosensitive member 22, damage of the photosensitive member 22 due to weakening material or bridging material applied to the transfer roller 24, etc., can be avoided while the apparatus is being transported or shipped.

[Exemplary Releasing Operation]

After the above-described separating operation, the process cartridge P is attached to the apparatus main body E and the image forming apparatus is packed and transported. Then, when a user activates the apparatus main body E, the transfer roller 24 is released from the separated state so that the image forming operation can be performed. The releasing operation will be described in detail below.

When the apparatus main body E is activated, the photosensitive member 22 is driven by the apparatus main body E. Accordingly, as shown in FIG. 9A, the transfer roller 24 and the release member 66 are rotated in the direction shown by the arrow B due to the engagement between the photosensitive-member gear 26 and the transfer gear 67. Accordingly, the release portion 66*a* of the release member 66 pushes the receiving surface 64*c* of the separation hook 64 and thereby moves the separation hook 64 in the direction shown by the arrow C in FIG. 9A. Thus, as shown in FIG. 3B, the latch portion 64*b* of the separation hook 64 moves away from the projecting portion 63*a* of the shaft cover 63. In addition, the stopper portion 64*a* of the separation hook 64 moves away from the projecting portion 60*b* of the bearing 60, and the state in which the stopper portion 64*a* of the separation hook 64 is in contact with the bearing projecting portion 60*b* is established, as shown in FIG. 3B. As a result, the bearing 60 is urged toward the photosensitive member 22 by the transfer spring 62, and accordingly the transfer roller 24 is moved to a normal operational position shown in FIG. 8B. Thus, the release member 66 is driven by a driving force applied by the photosensitive member 22, and accordingly the transfer roller 24 is unlatched from the separation hook 64 and returns to the first position at which the transfer roller 24 is in pressure contact with the photosensitive member 22 due to the force of the transfer spring 62.

As described above, it is not necessary for the user to perform any special task, and the separated state of the transfer roller 24 can be automatically canceled. Accordingly, the normal operational state in which the photosensitive member 22 and the transfer roller 24 are in pressure contact with each other can be established simply by activating the apparatus main body E. As a result, the above-described problems (permanent deformation of the transfer roller, rubbing between the transfer roller and the photosensitive member, damage of the photosensitive member caused by the weakening material or bridging material applied to the transfer roller, etc.) can be avoided. In addition, usability of the image forming apparatus can be improved.

In the first embodiment, the photosensitive member 22 is included in the process cartridge P. However, it is clear that similar effects can also be obtained in a structure where the photosensitive member 22 is included in the apparatus main body E of the image forming apparatus.

In addition, although the driving force is transmitted to the transfer roller 24 through the photosensitive-member gear 26 provided on the photosensitive member 22, it is clear that similar effects can also be obtained in a structure where the transfer roller 24 is driven by the rotation of the photosensitive member 22 that is in pressure contact therewith.

Second Exemplary Embodiment

An image forming apparatus according to a second embodiment will be described in detail below with reference to the drawings. In the second embodiment, components having similar functions to those of the first embodiment are denoted by the same reference numerals, and detailed explanations thereof are thus omitted. Accordingly, only characteristic parts of the second embodiment will be described below.

Figure 11B:
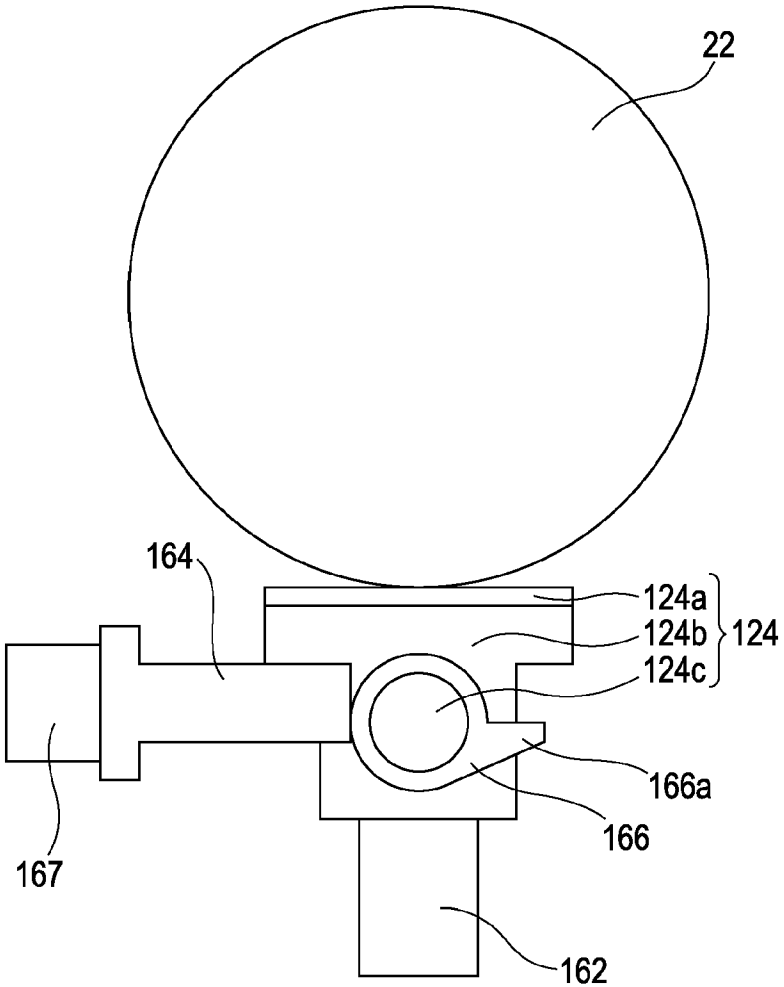
FIG. 11B is a schematic sectional view of the section around the transferring member according to the second embodiment.
Figure 11A:
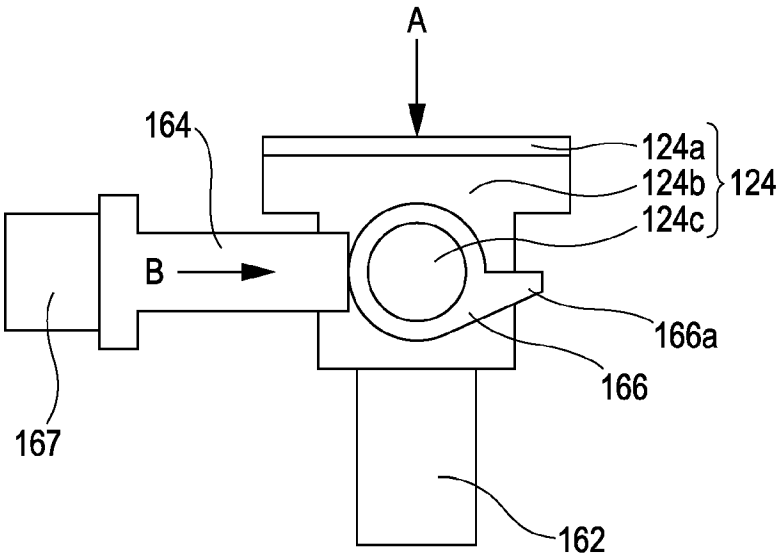
FIG. 11A is a schematic sectional view of an example section around a transferring member according to a second embodiment of the present invention.
Figure 12B:
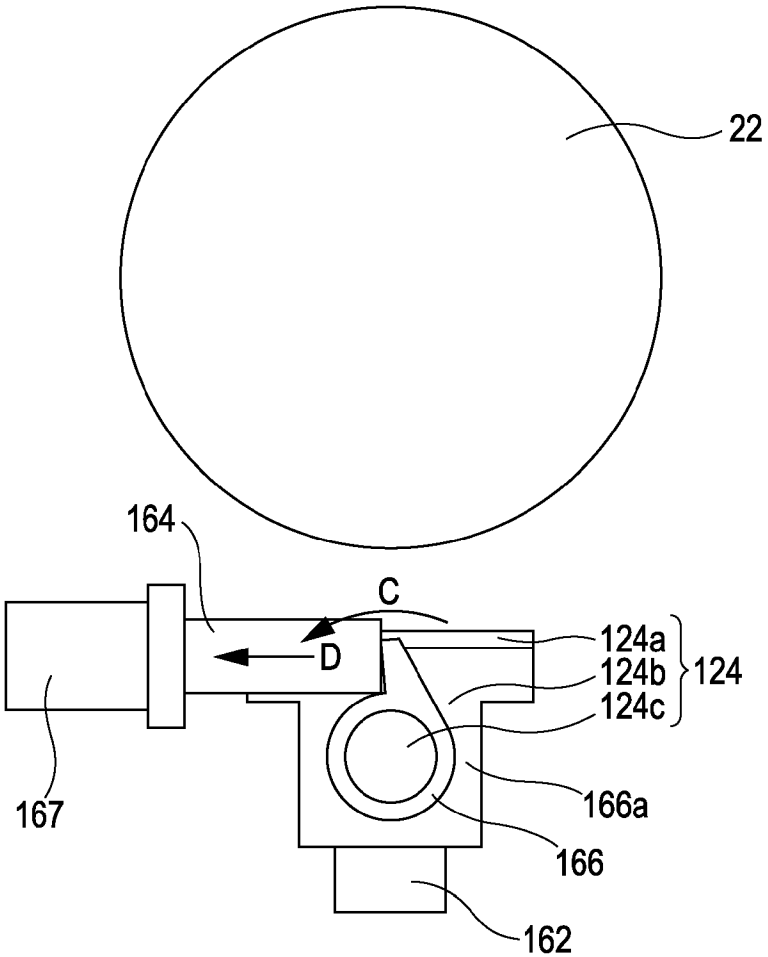
FIG. 12B is a schematic sectional view of the transferring unit illustrating the manner in which the releasing operation is performed in the second embodiment.
Figure 12A:
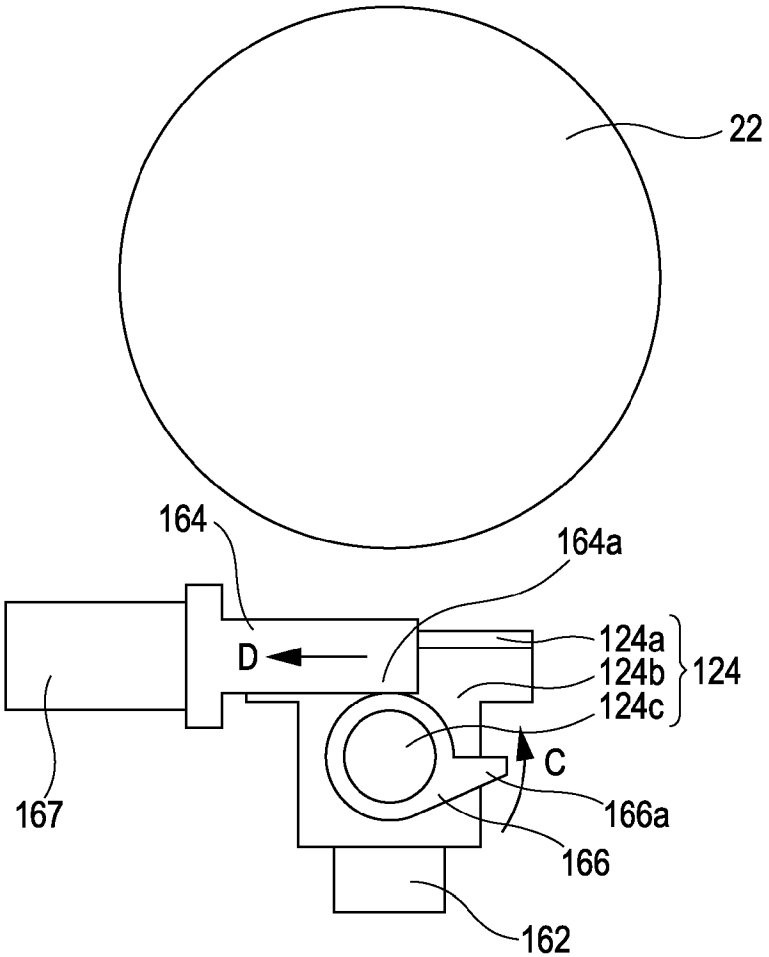
FIG. 12A is a schematic sectional view of a transferring unit illustrating the manner in which a releasing operation is performed in the second embodiment.
Figure 13:
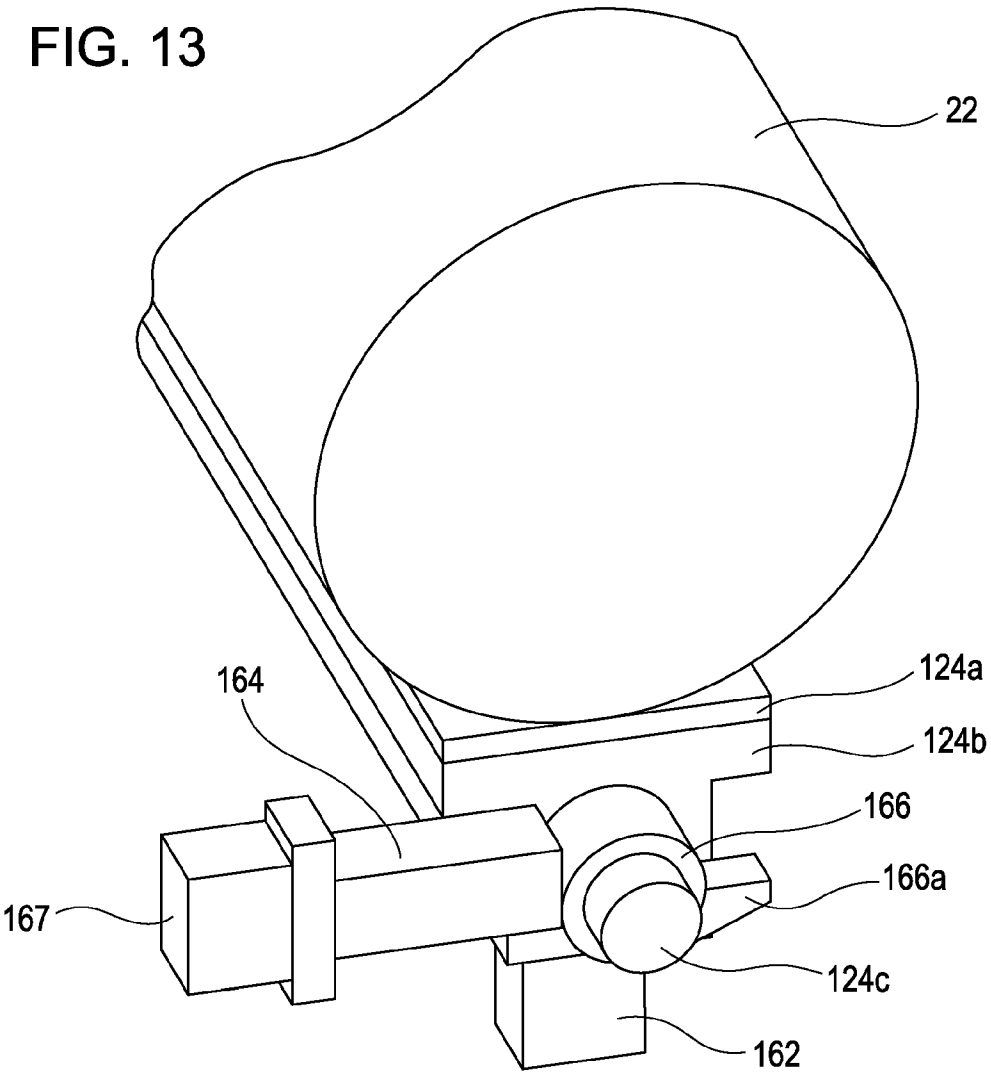
FIG. 13 is a schematic perspective view of the transferring member according to the second embodiment.

FIGS. 11A and 11B are schematic sectional views of a transferring unit included in an apparatus main body of the image forming apparatus. FIG. 11A illustrates the state in which the photosensitive member is removed from the apparatus main body, and FIG. 11B illustrates the state in which a transferring member is in pressure contact with the photosensitive member. FIGS. 12A and 12B are schematic sectional views of the transferring unit illustrating the manner in which a releasing operation is performed. FIG. 13 is a perspective view of the transferring unit shown in FIG. 11B.

[Exemplary Structure and Basic Operation of Transferring Unit]

The structure and basic operation of the transferring unit included in the image forming apparatus according to the second embodiment will be described below. As shown in FIGS. 11A to 14B, a transferring member 124 includes a transfer pad 124*a* that comes into pressure contact with the photosensitive member 22, a main body 124*b*, and a shaft portion 124*c* at each end of the transferring member 124. The main body 124*b* is supported by a transferring-member supporting portion (not shown) in the apparatus main body E such that the main body 124*b* can move along a direction in which the transferring member 124 comes into contact with the photosensitive member 22. The main body 124*b* is urged toward the photosensitive member 22 by a transfer spring 162 which functions as a pressing member. When the process cartridge P is not attached (when the photosensitive member 22 is removed from the apparatus main body E), as shown in FIG. 11A, the transferring member 124 comes into contact with a stopper portion (not shown) so that the transferring member 124 is prevented from being released from the apparatus main body E.

Similar to the first embodiment, the transferring member 124 is moveable between a first position (position shown in FIGS. 11A and 11B) at which the transferring member 124 is in pressure contact with the photosensitive member 22 and a second position (position shown in FIGS. 12A and 12B) at which the transferring member 124 is separated from the photosensitive member 22. Although the position at which the transferring member 124 is separated from the photosensitive member 22 is described as an example of the second position in the second embodiment, the present invention is not limited to this. For example, the second position of the transferring member 124 can also be a position where the pressure applied to the photosensitive member 22 is eliminated or reduced.

After the transferring member 124 is moved from the first position to the second position, the transferring member 124 is latched at the second position. In addition, when the transferring member 124 receives a driving force from the apparatus main body of the photosensitive member 22, the latched state is canceled and the transferring member 124 moves (returns) to the first position from the second position due to the force of the transfer spring 162. This will be described in more detail below.

A separation hook 164 for latching the transferring member 124 in the separated state is supported by a separation-hook supporting portion (not shown) in the apparatus main body E such that the separation hook 164 can move in the direction shown by the arrow B in FIG. 11A. The separation hook 164 is urged toward the transferring member 124 by an elastic member 167. The separation hook 164 function as a latch member for latching the transferring member 124 at the second position. In a normal operational state, an end of the separation hook 164 comes into contact with a release member 166, as shown in FIG. 11B.

Figure 14B:
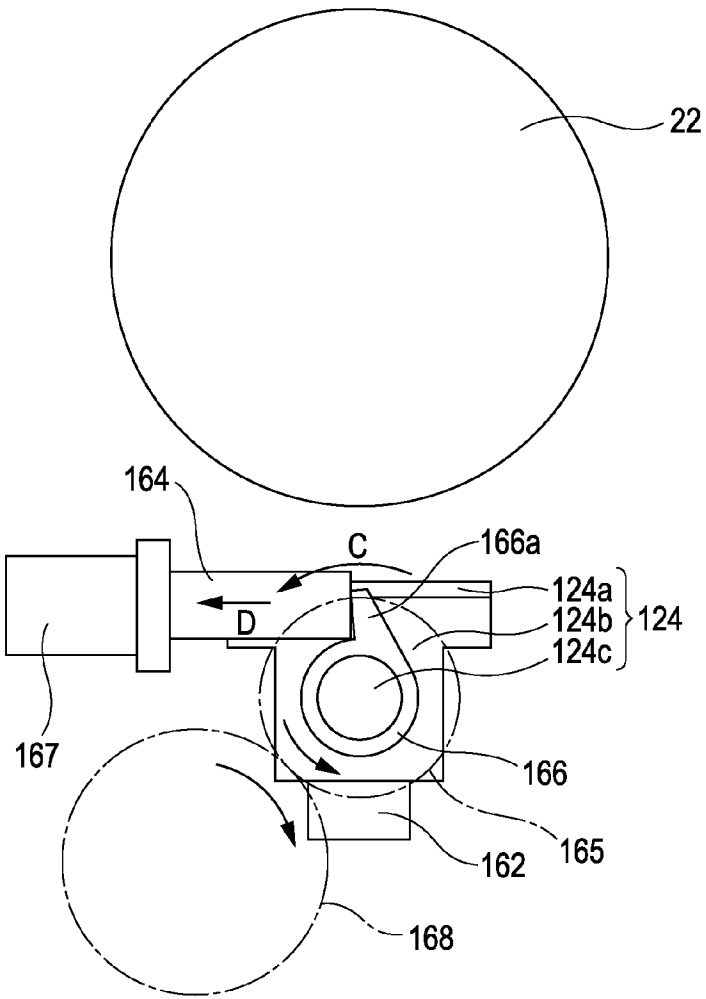
FIG. 14B is a schematic sectional view of the transferring unit illustrating the manner in which the releasing operation is performed in the second embodiment.
Figure 14A:
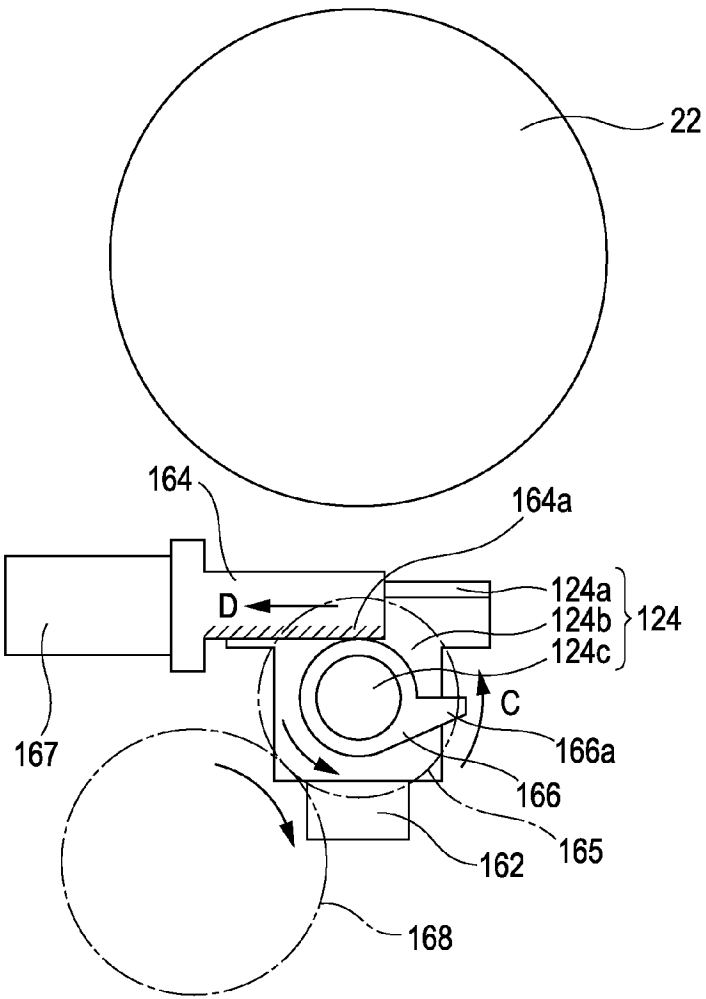
FIG. 14A is a schematic sectional view of the transferring unit illustrating the manner in which the releasing operation is performed in the second embodiment.

As shown in FIGS. 14A and 14B, the release member 166 has a release portion 166*a* for cancelling the separated state, and is rotatably supported on the shaft portion 124*c* of the transferring member 124 so that the release member 166 can rotate together with a releasing gear 165. The release member 166 provided on the transferring member 124 functions as an unlatching member for cancelling the state in which the transferring member 124 is latched at the second position by the separation hook 164.

When the apparatus main body E is manufactured, an operator performs a separating operation for the transferring member 124, which is extremely simple, before attaching the process cartridge P. The separating operation for the transferring member 124 will be described below. After the separating operation for the transferring member 124, the process cartridge P is attached to the apparatus main body E. At this time, the photosensitive member 22 and the transferring member 124 are reliably separated from each other in a stable state due to the above-mentioned separating operation. In this state, the image forming apparatus is packed and transported through various routes. Since the image forming apparatus is packed in a state in which the process cartridge P is attached to the apparatus main body E, the package box is small and the transportation efficiency is increased. After opening the package and installing the apparatus, the user activates the apparatus main body. Due to the activation of the apparatus main body, the separated state of the transferring member 124 is canceled, so that normal operations can be performed. Thus, the state in which the image-forming process can be performed is established without causing the user to perform a special task. The separating operation for the transferring member 124 and a releasing operation for cancelling the separated state will be described in more detail below.

[Exemplary Separating Operation]

The separating operation for the transferring member 124 performed to prevent the photosensitive member 22 in the process cartridge P from coming into contact with the transferring member 124 when the process cartridge P is attached to the apparatus main body E will be described below.

An operator performs the separating operation for the transferring member 124 before attaching the process cartridge P to the apparatus main body E. More specifically, the operator presses an upper portion of the transferring member 124 downward in the direction shown by the arrow A in FIG. 11A against the urging force of the transfer spring 162. Accordingly, the transferring member 124, the release member 166, and the releasing gear 165 are moved away from the position where the photosensitive member 22 is to be placed. At this time, as shown in FIG. 12A, an end portion of the separation hook 164 is released from the release member 166 and the separation hook 164 is moved in the direction shown by the arrow B in FIG. 11A by the urging force of the elastic member 167. Then, as shown in FIG. 12A, a latch portion 164*a* of the separation hook 164 presses the release member 166 against the urging force of the transfer spring 162, thereby maintaining the separated state of the transferring member 124. Thus, when the transferring member 124 is moved to the second position where the transferring member 124 is separated from the position where the photosensitive member 22 is to be placed, the separation hook 164 is moved to a latch position (position shown in FIGS. 12A and 12B) so as to latch the transferring member 124 at the second position.

In the separating operation, if a release portion 166*a* of the release member 166 is at a position where the release portion 166*a* comes into contact with the end portion of the separation hook 164, the release portion 166*a* is pushed by the end portion of the separation hook 164 and the release member 166 rotates accordingly. Therefore, the release portion 166*a* does not obstruct the movement of the transferring member 124 from the first position to the second position. Thus, simply by moving the transferring member 124 to the second position, the separation hook 164 can be moved to the position shown in FIG. 12A and the separated state of the transferring member 124 can be maintained.

As described above, the state in which the photosensitive member 22 and the transferring member 24 are separated from each other can be established by an extremely simple process, and the separated state can be stably maintained while the apparatus is being transported or shipped. As a result, the problems of permanent deformation of the transferring member 124, rubbing between the transferring member 124 and the photosensitive member 22, damage of the photosensitive member 22 due to weakening material or bridging material applied to the transferring member 124, etc., can be avoided while the apparatus is being transported or shipped. In addition, since the photosensitive member 22 is not used to maintain the separated state, the size of the photosensitive member 22 in the longitudinal (axial) direction thereof can be reduced. Therefore, the size of the apparatus main body E can be reduced.

[Exemplary Releasing Operation]

After the above-described separating operation, the process cartridge P is attached to the apparatus main body E and the image forming apparatus is packed and transported. Then, when a user activates the apparatus main body E, the transferring member 124 is released from the separated state so that normal operation can be performed. The releasing operation will be described in detail below.

When the apparatus main body E is activated, the release member 166 is driven by the apparatus main body E in the direction shown by the arrow C in FIG. 12B. In FIGS. 14A and 14B, gears included in a driving gear train are shown by the dashed lines. A driving force is transmitted from the apparatus main body E through an idler gear 168 and rotates the releasing gear 165 of the transferring member 124. Accordingly, the release member 166 is rotated in the direction shown by the arrow C in FIG. 14B. The release portion 166*a* of the release member 166 pushes the end portion of the separation hook 164, thereby moving the end portion of the separation hook 164 in the direction shown by the arrow D in FIG. 14B. Accordingly, the latch portion 164*a* of the separation hook 164 is separated from the release member 166. As a result, the transferring member 124 is urged toward the photosensitive member 22 by the transfer spring 162 and is thereby moved to the position shown in FIG. 11B. Thus, the release member 166 is driven by a driving force applied from the apparatus main body E, and the transferring member 124 is unlatched from the separation hook 164 and returns to the first position at which the transferring member 124 is in pressure contact with the photosensitive member 22 due to the force of the transfer spring 162.

As described above, it is not necessary for the user to perform any special task, and the separated state of the transferring member 124 can be automatically canceled. Accordingly, the normal operational state in which the photosensitive member 22 and the transferring member 124 are in pressure contact with each other can be established simply by activating the apparatus main body E. As a result, the above-described problems (permanent deformation of the transferring member, rubbing between the transferring member and the photosensitive member, damage of the photosensitive member caused by the weakening material or bridging material applied to the transferring member, etc.) can be avoided. In addition, usability of the image forming apparatus can be improved.

Although a pad-type transferring member 124 is described above as an example, it is clear that similar effects can be obtained when the transferring member 124 is a roller that is rotated by the rotation of the photosensitive member 22 that is in pressure contact therewith.

Other Exemplary Embodiments

In the above-described embodiments, an image forming apparatus having a single detachable process cartridge is described as an example. However, the number of process cartridges is not limited to this, and the present invention may also be effectively applied to an image forming apparatus having a plurality of detachable process cartridges.

In addition, in above-described embodiments, a process cartridge in which a photosensitive member, a charging unit that functions as a processing unit for processing the photosensitive member, a developing unit, and a cleaning are integrated is explained as an example of a detachable process cartridge that can be detachably attached to the main body of the image forming apparatus. However, the present invention is not limited to this, and any type of cartridge including a photosensitive member may be used.

In the above-described embodiments, a printer is described as an example of an image forming apparatus. However, the present invention is not limited to this, and the image forming apparatus may also be other types of image forming apparatuses, such as a copy machine, a facsimile machine, a multifunction machine having functions of both the copy machine and the facsimile machine, etc. Also in this case, similar effects can be obtained by applying the present invention to a transferring unit including an image bearing member and a transferring member that comes into pressure contact with the image bearing member.

While the present invention has been described with reference to exemplary embodiments, it is to be understood that the invention is not limited to the disclosed exemplary embodiments. The scope of the following claims is to be accorded the broadest interpretation so as to encompass all modifications, equivalent structures and functions.

This application claims the benefit of Japanese Application No. 2006-123941 filed Apr. 27, 2006, which is hereby incorporated by reference herein in its entirety.

What is claimed is:

1. An image forming apparatus comprising:

a supporting portion configured to support a cartridge, the cartridge being detachably attached to a main body of the image forming apparatus and including a rotatable image bearing member configured to bear a toner image;

a transferring roller configured to transfer the toner image from the image bearing member, the transferring roller being disposed in the main body and being moveable between a first position and a second position while the cartridge is attached to the main body and being capable of taking the first position and the second position while the cartridge is attached to the main body, the transferring roller and the image bearing member defining a nip section therebetween when the transferring roller is at the first position, the second position being farther away from the image bearing member than the first positions;

a first gear disposed in the image bearing member and configured to be driven by power transferred from the main body while the cartridge is attached to the main body;

a second gear disposed in the transferring roller and to which power is transmitted from the first gear;

a pressing member configured to press the transferring roller in a direction from the second position to the first position;

a holding member configured to hold the transferring roller at the second position;

a release member configured to move by the rotation of the transferring roller and release a state in which the holding member is holding the transferring roller, wherein a pitch interval is larger when the transferring roller is at the second position than when the transferring roller is at the first position and power can be transmitted from the first gear to the second gear whether the transferring roller is at the first position or the second position while the cartridge is attached to the main body, wherein the transferring roller is rotatable by the power transferred from the first gear to the second gear when the image bearing member rotates while the holding member is holding the transferring roller at the second position, wherein, when the cartridge is attached to the main body while the holding member is holding the transferring roller at the second position, the image bearing member rotates by the power transferred from the main body such that the power is transferred from the first gear to the second gear and the transferring roller rotates, the release member moves by the rotation of the transferring roller so as to release a state in which the holding member is holding the transferring roller.

2. An image forming apparatus according to claim 1, wherein, when the transferring roller is at the second position, the image bearing member and the transferring roller are separated from each other.

3. An image forming apparatus comprising:

a supporting portion configured to support a cartridge, the cartridge being detachably attached to a main body of the image forming apparatus and including a rotatable image bearing member configured to bear a toner image;

a transferring roller configured to transfer the toner image from the image bearing member, the transferring roller being disposed in the main body and being moveable between a first position and a second position while the cartridge is attached to the main body, the transferring roller and the image bearing member defining a nip section therebetween when the transferring roller is at the first position, the second position being farther away from the image bearing member than the first position;

a first gear disposed in the image bearing member and configured to be driven by power transferred from the main body while the cartridge is attached to the main body;

a second gear disposed in the transferring roller and to which power is transmitted from the first gear;

a pressing member configured to press the transferring roller in a direction from the second position to the first position;

a holding member configured to hold the transferring roller at the second position;

a release member configured to move by the rotation of the transferring roller and release a state in which the holding member is holding the transferring roller, wherein a pitch interval is larger when the transferring roller is at the second position than when the transferring roller is at the first position and power can be transmitted from the first gear to the second gear whether the transferring roller is at the first position or the second position while the cartridge is attached to the main body, wherein the transferring roller is rotatable by the power transferred from the first gear to the second gear when the image bearing member rotates while the holding member is holding the transferring roller at the second position.

4. An image forming apparatus according to claim 3, wherein, when the transferring roller is at the second position, the image bearing member and the transferring roller are separated from each other.

* * * * *